US007106253B2

(12) United States Patent
Yuanzhu

(10) Patent No.: US 7,106,253 B2
(45) Date of Patent: Sep. 12, 2006

(54) COMPACT ANTENNA DEVICE

(75) Inventor: Dou Yuanzhu, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 410 days.

(21) Appl. No.: 10/761,018

(22) Filed: Jan. 20, 2004

(65) Prior Publication Data

US 2004/0150566 A1 Aug. 5, 2004

(30) Foreign Application Priority Data

Jan. 23, 2003 (JP) ..... 2003-015006

(51) Int. Cl.
*H01Q 1/38* (2006.01)

(52) U.S. Cl. ..... 343/700 MS; 343/895; 343/752; 343/749; 343/745

(58) Field of Classification Search ..... 343/700 MS, 343/895, 752, 745, 749, 702, 846; 34/828, 34/848

See application file for complete search history.

(56) References Cited

U.S. PATENT DOCUMENTS

| | | | | |
|---|---|---|---|---|
| 4,860,020 | A | 8/1989 | Wong et al. | 343/828 |
| 6,008,773 | A * | 12/1999 | Matsuoka et al. | 343/818 |
| 6,337,666 | B1 * | 1/2002 | Bishop | 343/795 |
| 6,445,348 | B1 * | 9/2002 | McCoy et al. | 343/702 |
| 6,525,691 | B1 * | 2/2003 | Varadan et al. | 343/700 MS |
| 6,897,817 | B1 * | 5/2005 | Jo et al. | 343/702 |
| 6,992,627 | B1 * | 1/2006 | Honda et al. | 343/700 MS |
| 2002/0008664 | A1 | 1/2002 | Bark et al. | |
| 2002/0080088 | A1 | 6/2002 | Boyle | |

FOREIGN PATENT DOCUMENTS

| | | |
|---|---|---|
| EP | 0 989 629 | 8/1999 |
| JP | 2000-349532 | 12/2000 |
| JP | 2001-68917 | 3/2001 |
| JP | 2003-124729 | 4/2003 |
| WO | WO 01/11721 A1 | 2/2001 |

* cited by examiner

*Primary Examiner*—Tan Ho
*Assistant Examiner*—Chuc Tran
(74) *Attorney, Agent, or Firm*—Brinks Hofer Gilson & Lione

(57) ABSTRACT

An antenna includes a dielectric substrate disposed on a ground conductor and first and second radiating conductors containing meandering lines that are symmetrically disposed on a surface of the dielectric substrate and whose lower ends are connected at a junction. A third radiating conductor is disposed between the first radiating conductor and the second radiating conductor and extends in a straight line along the symmetry axis of both the radiating conductors. A capacitive conductor is disposed on the dielectric substrate and is substantially parallel to the ground conductor. The upper ends of the first, second and third radiating conductors are connected to the capacitive conductor. Power of a frequency supplied to the junction causes the first and second radiating conductors to resonate while power of a higher frequency causes the third radiating conductor to resonate.

43 Claims, 3 Drawing Sheets

COMPACT ANTENNA DEVICE

BACKGROUND OF THE INVENTION

1. Field of the Invention

The present invention relates to antenna devices suitable for being incorporated into in-vehicle telecommunication systems and the like.

2. Description of the Related Art

As shown in FIG. 5, an antenna device having a meandering radiating conductor patterned on a substrate is known as a compact antenna with a reduced height for being incorporated into an in-vehicle telecommunication system and the like (see, e.g., Japanese Unexamined Patent Application Publication No. 2000-349532 (in particular, pages 3 to 4, FIG. 1)).

In an antenna device 1 shown in FIG. 5, a meandering radiating conductor 3 made of copper foil is formed on a surface of a dielectric substrate 2 that is placed upright on a ground conductor 4, and high-frequency power is supplied to the lower end of the radiating conductor 3 via a power feeder such as a coaxial cable. As compared to the height of a radiating conductor formed in a straight line and having the same electrical length, the height of the meandering radiating conductor 3 is significantly lower, and thus use of the meanderline structure is advantageous in reducing the height of the antenna as a whole.

As shown in FIG. 6, moreover, an antenna device with a radiating conductor including two different pitches of meandering lines joined together and formed on a substrate surface has been used as a compact antenna that can send and receive signal waves of two frequency bands (see, e.g., Japanese Unexamined Patent Application Publication No. 2001-68917 (in particular, pages 3 to 4, FIG. 1)).

In a dual-band antenna device 5 shown in FIG. 6, a radiating conductor 8 made of copper foil is patterned on a surface of a dielectric substrate 7 that is placed upright on a ground conductor 6. The radiating conductor 8 is a combination of a first radiating conductor 8*a* meandering from the side adjacent to a feeding point with a relatively wide pitch, and a second radiating conductor 8*b* meandering from the end of the first radiating conductor 8*a* with a relatively narrow pitch. Supply of power of a first high-frequency to the feeding point of the radiating conductor 8 via a power feeder such as a coaxial cable allows the entire radiating conductor 8, which extends from the first radiating conductor 8*a* to the second radiating conductor 8*b*, to resonate at a first frequency $f_1$. However, supply of power of a second high-frequency to the feeding point allows only the first radiating conductor 8*a* to resonate at a second frequency $f_2$ that is higher than the first frequency $f_1$. Since a meandering line with a narrow pitch (the second radiating conductor 8*b*) tends to impair the flow of a high-frequency current with a higher frequency, the second frequency $f_2$ can allow only the first radiating conductor 8*a* to function as a radiating element.

In the above-described antenna device 1 and the antenna device 5 that are known, excessively narrow meandering pitches of the radiating conductor 3 and the radiating conductor 8 tend to cause higher mode resonances. A possible approach to reducing the antenna height, in this case, is to narrow the widths of the radiating conductor 3 and the radiating conductor 8, but their excessively narrow widths result in reduction in gain and narrowing of the resonant frequency band. In the antenna device 1 and the antenna device 5, therefore, it is difficult to reduce the antenna height while maintaining a sufficient gain and bandwidth.

Reducing the height of the entire antenna is particularly difficult in the dual-band antenna device 5, because in the radiating conductor 8*a* and the radiating conductor 8*b* the two different meandering pitches are connected in series. This inevitably increases the length of the radiating conductor 8.

SUMMARY OF THE INVENTION

Aspects of the present invention thus provide a high-performance antenna device with reduced height as well as a high-performance dual-band Antenna device with reduced height.

An antenna device according to one aspect of the present invention includes a ground conductor, a dielectric substrate, and a capacitive conductor. The dielectric substrate is placed upright on the ground conductor and has first and second radiating conductors that meander and are symmetrically disposed on a surface of the first dielectric substrate. Lower ends of the first and second radiating conductors are connected at a junction. The capacitive conductor is disposed on the dielectric substrate and is connected to upper ends of the first and second radiating conductors.

Since the first radiating conductor and the second radiating conductor symmetrically disposed both resonate, the gain significantly increases and the bandwidth of the resonant frequency also increases in the above-described antenna device. Even the first radiating conductor and the second radiating conductor are formed in meandering lines with slightly narrowed widths for reducing the antenna height, a reduction in gain and narrowing of the bandwidth can therefore be prevented. The capacitive conductor, which functions as a reducing capacitor for reducing the resonant frequency when the first radiating conductor and the second radiating conductor resonate, reduces the electrical lengths required for resonance at a predetermined frequency in both radiating conductors. This is also advantageous in reducing the antenna height. While the antenna device maintains a desired gain and bandwidth, the height of the antenna device can be reduced without difficulty.

An antenna device according to a second aspect of the present invention further includes a third radiating conductor disposed on a surface of the dielectric substrate between the first and second radiating conductors. The third radiating conductor extends in a straight line along an axis around which the first and second radiating conductors are symmetrically disposed and is capacitively coupled with the junction. The third radiating conductor is configured to resonate at a higher frequency than the first and second radiating conductors.

In the first radiating conductor and the second radiating conductor that are meandering and are included in the above-described antenna device, the inductive reactance increases to impair the flow of current as the frequency of the high-frequency power increases. In the third radiating conductor 18, which is capacitively coupled with the junction 15, the flow of current is impared as the frequency decreases. Therefore, supply of a high-frequency power with a relatively low frequency resonates the first radiating conductor and the second radiating conductor with meandering shapes, and supply of a high-frequency power with a relatively high frequency resonates the third radiating conductor. Since the third radiating conductor is disposed on the area where each electric field generated by the first radiating conductor and the second radiating conductor cancels each other out, the first radiating conductor and the second radiating conductor do not adversely affect the resonance of the third radiating conductor. A high-performance dual-band antenna device that has a reduced height and resonates at two levels of frequency (high and low) can thus be achieved. Connecting the upper end of the third radiating conductor to the capacitive conductor allows the third radiating conductor to reduce its electrical length required for resonance at a predetermined frequency. This is advantageous in reducing the antenna height.

Incidentally, a second dielectric substrate may be disposed on the dielectric substrate and substantially parallel to the ground conductor, and the capacitive conductor may be a conductive layer disposed on the surface of the second dielectric substrate. Alternatively, the second dielectric substrate may be omitted and a metal conductive plate disposed on the dielectric substrate may be a capacitive conductor.

DESCRIPTION OF THE PREFERRED EMBODIMENTS

The embodiments of the present invention will be described with reference to drawings.

Figure 1:
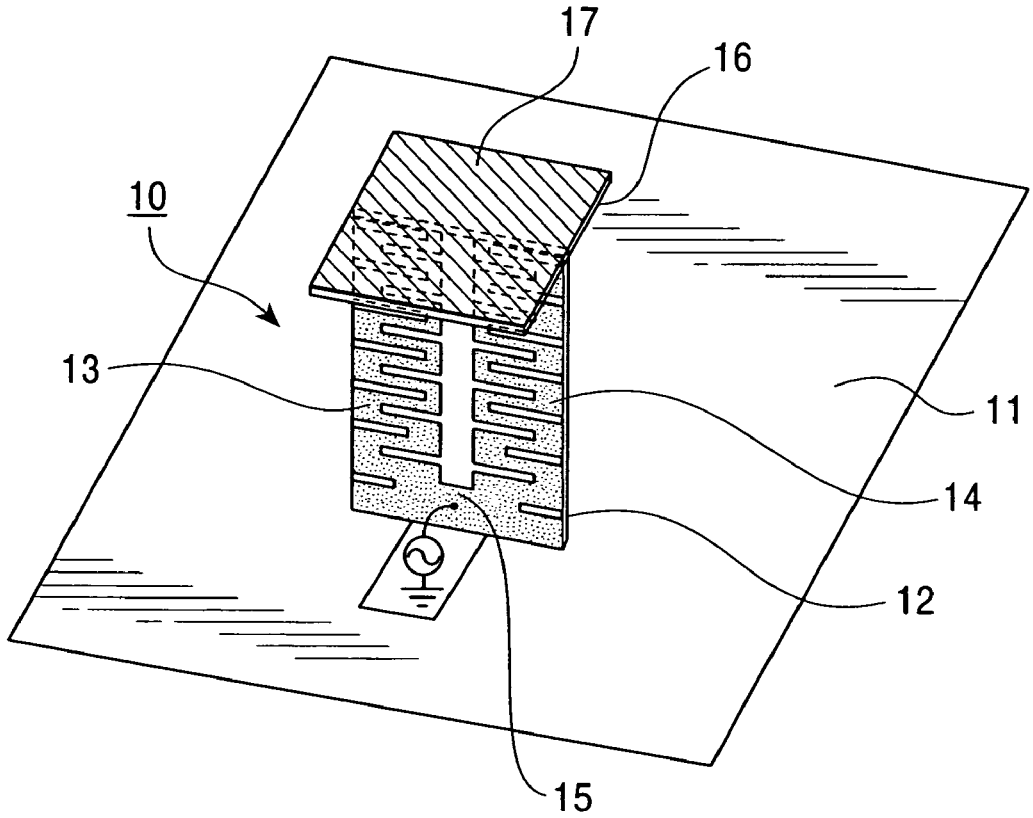
FIG. 1 is a perspective view of an antenna device according to an embodiment of the present invention.
Figure 2:
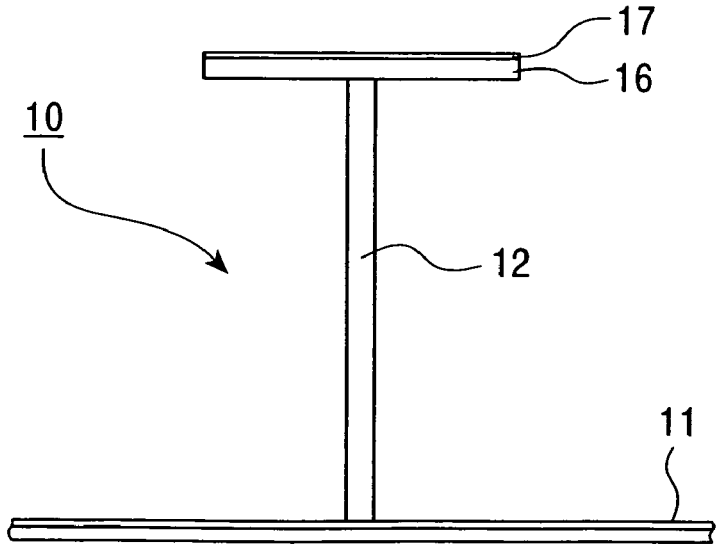
FIG. 2 is a side view of the antenna device shown in FIG. 1.

FIG. 1 is a perspective view of a single-band antenna device according to an embodiment of the present invention, and FIG. 2 is a side view of the antenna device.

In an antenna device 10 shown in these figures, a first radiating conductor 13 and a second radiating conductor 14 are made of, for example, copper foil. The first and second radiating conductors 13, 14 are meandering and are symmetrically disposed on a surface of a dielectric substrate 12 that is placed upright on a ground conductor 11. This is to say that the dielectric substrate 12 is disposed on the ground conductor 11 such that the dielectric substrate 12 extends in a direction substantially perpendicular to the direction in which the ground conductor 11 extends. Lower ends of the first radiating conductor 13 and the second radiating conductor 14 are connected at a junction 15. A power feeder such as a coaxial cable (not shown) is connected to the junction 15, and high-frequency power is supplied to each lower end of the first radiating conductor 13 and the second radiating conductor 14 via the power feeder. A compact dielectric substrate 16 is disposed on the dielectric substrate 12 and is substantially parallel to the ground conductor 11. A capacitive conductor 17 made of, for example, copper foil covers substantially the entire upper surface of the compact dielectric substrate 16, and is connected to the upper ends of the first radiating conductor 13 and the second radiating conductor 14 via, for example, one or more through holes.

In the antenna device 10, the first radiating conductor 13 and the second radiating conductor 14 that are symmetrically disposed both resonate when high-frequency power is supplied to the lower ends (junction 15) thereof. The antenna device 10 containing one of the first radiating conductor 13 or the second radiating conductor 14 has a gain of about double and has a resonant frequency with a wider bandwidth of the resonant frequency than a conventional antenna device. Even if the widths of the meandering lines of the first radiating conductor 13 and the second radiating conductor 14 are slightly narrowed compared to the conventional antenna to further reduce the antenna height, a high-performance antenna device with a high gain and a sufficient bandwidth can be achieved. Since the capacitive conductor 17 connected to the upper ends of the first radiating conductor 13 and the second radiating conductor 14 functions as a reducing capacitor for reducing the resonant frequency, the electrical lengths required for resonance at a predetermined frequency are reduced in the first radiating conductor 13 and the second radiating conductor 14. This is also advantageous in reducing the antenna height. While the antenna device 10 maintains a desired gain and bandwidth, the height of the antenna device 10 can be reduced without difficulty.

Figure 3:
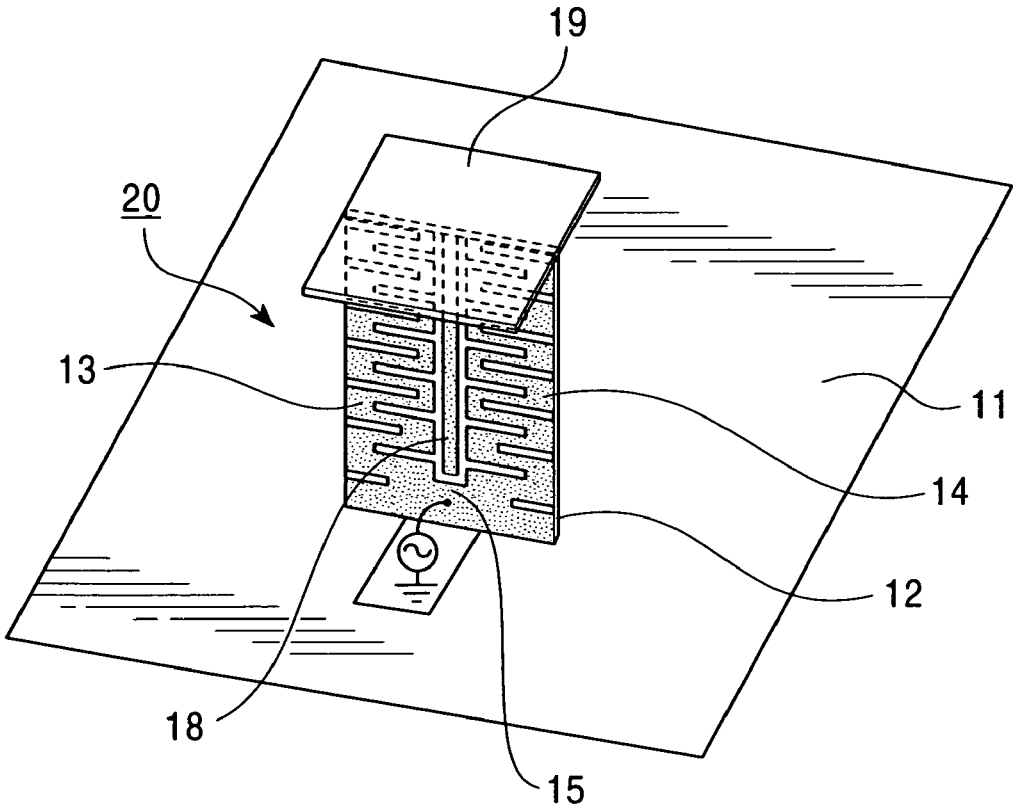
FIG. 3 is a perspective view of an antenna device according to the other embodiment of the present invention.
Figure 4:
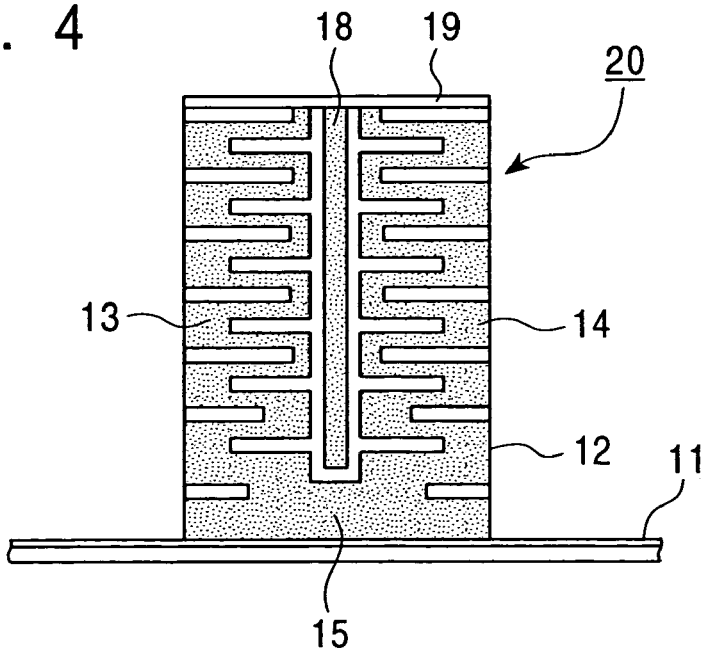
FIG. 4 is a front view of the antenna device shown in FIG. 3.
Figure 5:
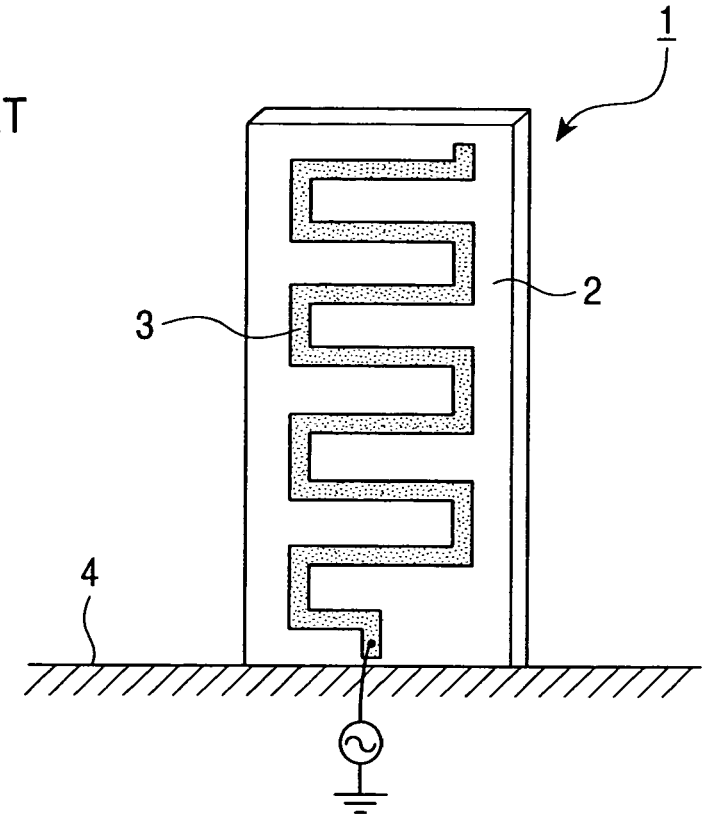
FIG. 5 PRIOR ART
FIG. 5 is a schematic diagram showing a known example of an antenna device.
Figure 6:
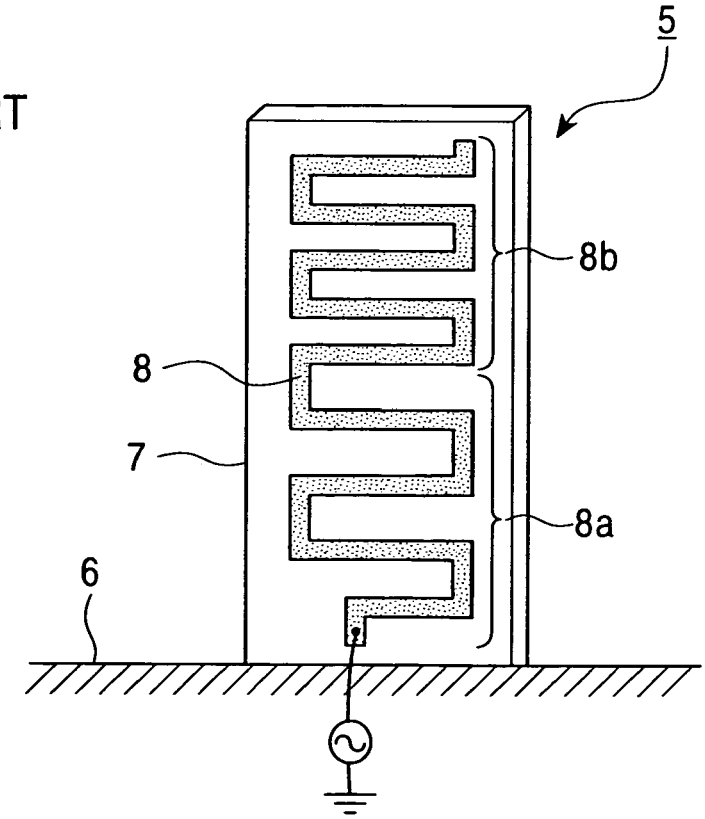
FIG. 6 PRIOR ART
FIG. 6 is a schematic diagram showing another known example of an antenna device.

FIG. 3 is a perspective view of a dual-band antenna device according to the other embodiment of the present invention, and FIG. 4 is a front view of the antenna device. The parts corresponding to those in FIGS. 1 and 2 are indicated by the same reference numerals.

An antenna device 20 shown in FIGS. 3 and 4 is different from the above-described embodiment. In this embodiment, a third radiating conductor 18 extends in a straight line along the symmetry axis between the first radiating conductor 13 and the second radiating conductor 14. The third radiating conductor 18 is capacitively coupled with the junction 15 of the first radiating conductor 13 and the second radiating conductor 14. A capacitive conductor 19 made of a metal (or other conductive material) plate is disposed on the dielectric substrate 12 and connects to each upper end of the first radiating conductor 13, second radiating conductor 14, and the third radiating conductor 18.

In the antenna device 20, similar to the above-described embodiment, the first radiating conductor 13 and the second radiating conductor 14 have meandering shapes that resonate when power of a predetermined (first frequency $f_1$) is supplied to the junction 15, and the capacitive conductor 19 functions as a reducing capacitor. The third radiating conductor 18 placed upright on the ground conductor 11 resonates when a second frequency $f_2$ that is higher than the first frequency $f_1$ is supplied to the junction 15, and the capacitive conductor 19 also functions as a reducing capacitor.

The third radiating conductor 13 may be disposed on the same surface of the dielectric as the first and second radiating conductors 13 and 14, as shown in FIGS. 3 and 4, thereby saving space on the opposite surface of the dielectric substrate 12 for circuitry, for example, or may be disposed on the opposite surface of the dielectric substrate 12 as the first and second radiating conductors 13 and 14, thereby increasing the area available on the surface of the dielectric on which the first and second radiating conductors 13 and 14 are disposed. If the third radiating conductor 13 is disposed on the opposite surface of the dielectric substrate 12 as the first and second radiating conductors 13 and 14, the third radiating conductor 13 may remain capacitively coupled with the junction 15 through the dielectric substrate 12 (perhaps overlapping the junction 15) or a conductive patch connected with the junction 15 may be disposed on the same side of the dielectric conductor 12 as the third radiating conductor 13.

The use of meandering shapes in the first radiating conductor 13 and the second radiating conductor 14 increases the inductive reactance to impair the flow of current as the frequency of the high-frequency power increases. In the third radiating conductor 18, which is capacitively coupled with the junction 15, the flow of current is impared as the frequency decreases. As described above, supply of high-frequency power with a relatively low frequency $f_1$ causes the first radiating conductor 13 and the second radiating conductor 14 to resonate, and supply of high-frequency power with a relatively high frequency $f_2$ causes only the third radiating conductor 18 to resonate, like a monopole antenna. A dual-band antenna can thus be obtained. The height of the antenna device 20 can be easily reduced because the capacitive conductor 19 functions as a reducing capacitor in resonance at both frequencies $f_1$ and $f_2$.

Since the third radiating conductor 18 of the antenna device 20 is disposed on the area where the electric fields generated by the first radiating conductor 13 and the second radiating conductor 14 cancel each other out, the first radiating conductor 13 and the second radiating conductor 14 do not adversely affect the resonance of the third radiating conductor 18. That is, whereas supply of high-frequency power with a frequency $f_2$ allows a higher-frequency current to flow mainly into the third radiating conductor 18, the first radiating conductor 13 and the second radiating conductor 14 generate undesirable electric fields at the resonance of the third radiating conductor 18 due to the high-frequency current partially flowing into the first radiating conductor 13 and the second radiating conductor 14. However, since these undesirable electric fields cancel each other out in the vicinity of the third radiating conductor 18, the first radiating conductor 13 and the second radiating conductor 14 do not affect the radiating pattern at the resonance of the third radiating conductor 18.

The antenna device 20 exhibits excellent antenna characteristics in resonance at both high and low frequencies, reduces its height without difficulty, and can be used as a useful dual-band antenna suitable for in-vehicle telecommunication systems and the like.

It is intended that the foregoing detailed description be regarded as illustrative rather than limiting, and that it be understood that it is the following claims, including all equivalents, that are intended to define the spirit and scope of this invention.

What is claimed is:

1. An antenna device comprising:

a ground conductor;

a first dielectric substrate placed upright on the ground conductor;

a first radiating conductor and a second radiating conductor that meander and are symmetrically disposed on a surface of the first dielectric substrate, lower ends of the first radiating conductor and the second radiating conductor being connected at a junction; and a capacitive conductor disposed on the first dielectric substrate and connected to upper ends of the first radiating conductor and the second radiating conductor.

2. An antenna device according to claim 1, further comprising a third radiating conductor disposed on the surface of the first dielectric substrate between the first radiating conductor and the second radiating conductor and extending in a straight line along an axis around which the first radiating conductor and the second radiating conductor are symmetrically disposed, the third radiating conductor capacitively coupled with the junction and configured to resonate at a higher frequency than the first and second radiating conductors.

3. An antenna device according to claim 2, wherein an upper end of the third radiating conductor is connected to the capacitive conductor.

4. An antenna device according to claim 2, further comprising a power supply connected between the ground conductor and the junction, the power supply supplying high-frequency power to the junction to resonate at least one of the first and second radiating conductors and the third radiating conductor, the first and second radiating conductors radiating at substantially the same frequency.

5. An antenna device according to claim 1, further comprising a second dielectric substrate disposed on the first dielectric substrate, a conductive layer forming the capacitive conductor disposed on a surface of the second dielectric substrate.

6. An antenna device according to claim 5, wherein the second dielectric substrate is disposed substantially parallel to the ground conductor.

7. An antenna device according to claim 6, wherein a first surface of the second dielectric substrate contacts the first dielectric substrate and the conductive layer is disposed on a second surface of the second dielectric substrate opposing the first dielectric substrate.

8. An antenna device according to claim 7, wherein the conductive layer is connected to the first and second radiating conductors via through holes.

9. An antenna device according to claim 1, wherein the capacitive conductor is a solid conductive plate.

10. An antenna device according to claim 9, wherein the conductive plate is disposed on an end of the first dielectric substrate and is substantially parallel to the ground conductor.

11. An antenna device according to claim 1, wherein the capacitive conductor is disposed substantially parallel to the ground conductor.

12. An antenna device according to claim 1, further comprising a third radiating conductor disposed on a straight line along an axis around which the first radiating conductor and the second radiating conductor are symmetrically disposed, the third radiating conductor capacitively coupled with the junction and configured to resonate at a higher frequency than the first and second radiating conductors.

13. An antenna device according to claim 12, wherein an upper end of the third radiating conductor is connected to the capacitive conductor.

14. An antenna device according to claim 12, further comprising a power supply connected between the ground conductor and the junction, the power supply supplying high-frequency power to the junction to resonate at least one of the first and second radiating conductors and the third radiating conductor, the first and second radiating conductors radiating at substantially the same frequency.

15. An antenna device comprising:

a ground conductor;

a first dielectric substrate disposed on the ground conductor;

a first set of radiating conductors disposed on a surface of the first dielectric substrate, the first set of the radiating conductors directly connected to the ground conductor and disposed to provide an area on the surface of the first dielectric substrate where electric fields generated by the first set of the radiating conductors cancel each other out; and a capacitive conductor disposed on the first dielectric substrate and connected to the first set of the radiating conductors.

16. An antenna device according to claim 15, wherein the first set of the radiating conductors are connected together at a connection point such that a distance from the connection point in a particular radiating conductor in the first set of the radiating conductors to a ground connection where the particular radiating conductor contacts the ground conductor is the same as the distance in the other radiating conductors in the first set of the radiating conductors.

17. An antenna device according to claim 16, wherein ends of the radiating conductors in the first set of the radiating conductors are connected together.

18. An antenna device according to claim 15, wherein the radiating conductors in the first set of radiating conductors contain meandering lines.

19. An antenna device according to claim 15, further comprising a second dielectric substrate disposed on the first dielectric substrate, a conductive layer forming the capacitive conductor disposed on a surface of the second dielectric substrate.

20. An antenna device according to claim 19, wherein the second dielectric substrate is disposed substantially parallel to the ground conductor.

21. An antenna device according to claim 20, wherein a first surface of the second dielectric substrate contacts the first dielectric substrate and the conductive layer is disposed on a second surface of the second dielectric substrate opposing the first dielectric substrate.

22. An antenna device according to claim 21, wherein the conductive layer is connected to the first set of radiating conductors via through holes.

23. An antenna device according to claim 15, wherein the capacitive conductor is a solid conductive plate.

24. An antenna device according to claim 23, wherein the conductive plate is disposed on an end of the first dielectric substrate and is substantially parallel to the ground conductor.

25. An antenna device according to claim 15, further comprising at least one radiating conductor disposed in the area on the surface of the first dielectric substrate where electric fields generated by the first set of the radiating conductors cancel each other out, the at least one radiating conductor configured to resonate at a higher frequency than the conductors in the first set of radiating conductors.

26. An antenna device according to claim 25, wherein the radiating conductors in the first set of radiating conductors contain meandering lines and the at least one radiating conductor is straight.

27. An antenna device according to claim 26, wherein the at least one radiating conductor is disposed along an axis around which the first set of radiating conductors are symmetrically disposed.

28. An antenna device according to claim 25, wherein the at least one radiating conductor is capacitively coupled the first set of radiating conductors.

29. An antenna device according to claim 28, wherein the at least one radiating conductor is capacitively coupled the first set of radiating conductors at a connection point connecting the radiating conductors in the first set of radiating conductors.

30. An antenna device according to claim 28, wherein the at least one radiating conductor is connected to the capacitive conductor.

31. An antenna device according to claim 25, further comprising a power supply connected between the ground conductor and the first set of radiating conductors, the power supply supplying high-frequency power to the first set of radiating conductors to resonate at least one of the first set of radiating conductors and the at least one radiating conductor.

32. A method of fabricating an antenna device, the method comprising:

providing a ground conductor;

attaching a first dielectric substrate to the ground conductor such that a first set of radiating conductors disposed on a surface of the first dielectric substrate directly contact the ground conductor, the first set of radiating conductors disposed to provide an area on the surface of the first dielectric substrate where electric fields generated by the first set of the radiating conductors cancel each other out; and attaching a capacitive conductor to the first dielectric substrate such that the first set of the radiating conductors are in electrical contact with the capacitive conductor.

33. A method according to claim 32, further comprising forming the first set of radiating conductors on the surface of the first dielectric substrate.

34. A method according to claim 32, wherein the radiating conductors in the first set of radiating conductors contain meandering lines and ends of the radiating conductors in the first set of the radiating conductors are connected together.

35. A method according to claim 32, further comprising attaching a second dielectric substrate on the first dielectric substrate such that the second dielectric substrate is disposed substantially parallel to the ground conductor, a conductive layer forming the capacitive conductor disposed on a surface of the second dielectric substrate.

36. A method according to claim 32, wherein the capacitive conductor is a solid conductive plate.

37. A method according to claim 32, wherein the conductive plate is disposed on an end of the first dielectric substrate and is substantially parallel to the ground conductor.

38. A method according to claim 32, further comprising at least one radiating conductor disposed in the area on the surface of the first dielectric substrate where electric fields generated by the first set of the radiating conductors cancel each other out, the at least one radiating conductor configured to resonate at a higher frequency than the conductors in the first set of radiating conductors.

39. A method according to claim 38, wherein the radiating conductors in the first set of radiating conductors contain meandering lines, ends of the radiating conductors in the first set of the radiating conductors are connected together, and the at least one radiating conductor is straight.

40. A method according to claim 39, wherein the at least one radiating conductor is disposed along an axis around which the first set of radiating conductors are symmetrically disposed.

41. A method according to claim 39, further comprising supplying high-frequency power to the ends of the first set of radiating conductors to resonate at least one of the first set of radiating conductors and the at least one radiating conductor.

42. A method according to claim 38, wherein the at least one radiating conductor is capacitively coupled the first set of radiating conductors at a connection point connecting the radiating conductors in the first set of radiating conductors.

43. A method according to claim 38, further comprising attaching the capacitive conductor to the first dielectric substrate such that the at least one radiating conductor electrically contacts the capacitive conductor.

* * * * *